US009240626B2

(12) United States Patent
Christie

(10) Patent No.: US 9,240,626 B2
(45) Date of Patent: Jan. 19, 2016

(54) SNAP ATTACHMENT FOR REFLECTOR MOUNTING

(75) Inventor: Nathan Andrew Christie, Acworth, GA (US)

(73) Assignee: Pro Brand International, Inc., Marietta, GA (US)

( * ) Notice: Subject to any disclaimer, the term of this patent is extended or adjusted under 35 U.S.C. 154(b) by 575 days.

(21) Appl. No.: 13/553,874

(22) Filed: Jul. 20, 2012

(65) Prior Publication Data

US 2013/0021221 A1 Jan. 24, 2013

Related U.S. Application Data

(60) Provisional application No. 61/510,311, filed on Jul. 21, 2011.

(51) Int. Cl.

| | |
|---|---|
| ***H01Q 15/14*** | (2006.01) |
| ***H01Q 1/12*** | (2006.01) |
| ***H01Q 1/08*** | (2006.01) |
| ***H01Q 15/16*** | (2006.01) |

(52) U.S. Cl.
CPC ..... *H01Q 1/1207* (2013.01); *H01Q 1/088* (2013.01); *H01Q 15/16* (2013.01)

(58) Field of Classification Search
CPC ..... H01Q 1/088; H01Q 15/16; H01Q 1/1207
See application file for complete search history.

(56) References Cited

U.S. PATENT DOCUMENTS

| | | | | |
|---|---|---|---|---|
| 3,973,301 | A | 8/1976 | Buhr | |
| 4,608,571 | A * | 8/1986 | Luly | 343/781 P |
| 5,003,321 | A * | 3/1991 | Smith et al. | 343/781 R |
| 5,310,144 | A | 5/1994 | Salvatore et al. | |
| 5,526,010 | A * | 6/1996 | Plunk | 343/882 |
| 5,644,322 | A * | 7/1997 | Hayes et al. | 343/915 |
| 5,933,123 | A | 8/1999 | Kaul | |
| 6,433,757 | B1 * | 8/2002 | Shrader | 343/915 |
| 6,452,567 | B1 | 9/2002 | Overton | |
| 8,451,187 | B2 * | 5/2013 | Zihlman | 343/882 |
| 2009/0160726 | A1 | 6/2009 | Peng | |
| 2010/0171677 | A1 * | 7/2010 | Rakotoarisoa | 343/837 |
| 2011/0032172 | A1 * | 2/2011 | Kirby et al. | 343/878 |
| 2011/0095956 | A1 * | 4/2011 | Conrad | 343/840 |
| 2011/0140985 | A1 * | 6/2011 | Marth et al. | 343/878 |

OTHER PUBLICATIONS

PCT Search Report and Written Opinion for International Patent Application Serial No. PCT/US12/47540, mailed Oct. 1, 2012, consists of 9 unnumbered pages.

* cited by examiner

*Primary Examiner* — Trinh Dinh

(57) ABSTRACT

A mount for mounting a reflector of a satellite dish is provided. In one embodiment, the mount includes one or more first hooks and one or more second hooks located offset from the one or more first hooks, wherein the one or more second hooks are spring loaded and the one or more first hooks and the one or more second hooks fasten the reflector of the satellite dish to the mount.

17 Claims, 9 Drawing Sheets

SECTION I-I

SECTION J-J

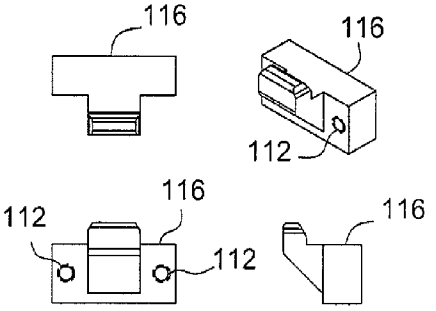
FIG. 21
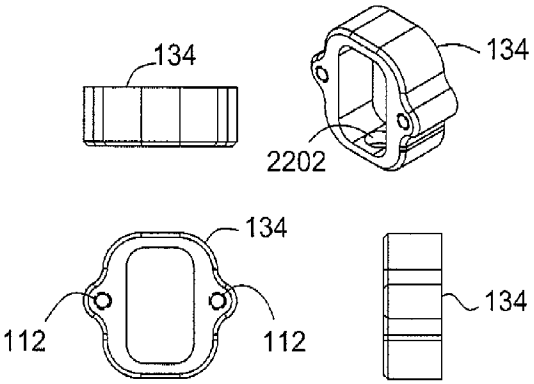
FIG. 22
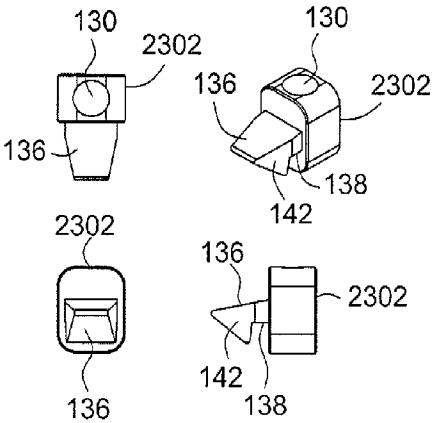
FIG. 23
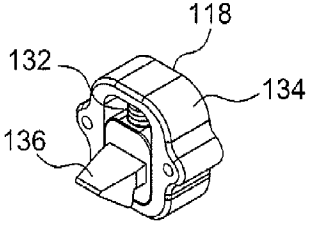
FIG. 24
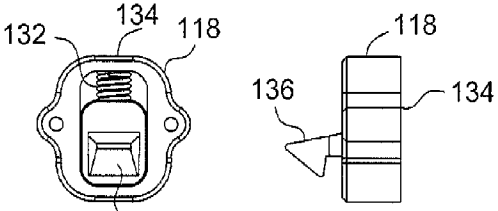
FIG. 25
FIG. 26
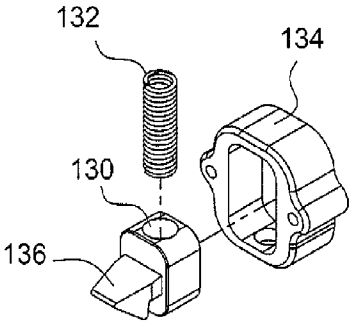
FIG. 27

SNAP ATTACHMENT FOR REFLECTOR MOUNTING

CROSS REFERENCE TO RELATED APPLICATIONS

This application claims the benefit of U.S. Provisional Patent Application Ser. No. 61/510,311, filed on Jul. 21, 2011, which is herein incorporated by reference in its entirety.

BACKGROUND

Typically, satellite dishes are relatively heavy and installed in higher locations, which make installation of the satellite dishes challenging. Moreover, current satellite dish installation requires the use of a nut and bolt to anchor the satellite dish to a mount. Securing the satellite dish with a nut and bolt may require multiple people to install the satellite dish as one person may be required to hold the satellite dish while another person securely mounts the satellite dish with the nut and bolt combination. As a result, currently used methods for installing a satellite dish may be inefficient with respect to time and cost.

SUMMARY

In one embodiment, the present disclosure describes a mount for mounting a reflector of a satellite dish. In one embodiment, the mount comprises one or more first hooks and one or more second hooks located offset from the one or more first hooks, wherein the one or more second hooks are spring loaded and the one or more first hooks and the one or more second hooks fasten the reflector of the satellite dish to the mount.

In another embodiment, the present disclosure describes a satellite dish system. The satellite dish system comprises a satellite dish comprising a reflector, the reflector comprising a first set of openings and a second set of openings offset from the first set of openings and a mount. The mount comprises one or more first hooks coupled to the first set of openings and one or more second hooks located offset from the one or more first hooks and coupled to the second set of openings, wherein the one or more second hooks are spring loaded and the one or more first hooks and the one or more second hooks fasten the reflector of the satellite dish to the mount.

In another embodiment, the present disclosure describes a method for method for mounting a satellite dish. In one embodiment, the method comprises providing the satellite dish having a reflector, the reflector comprising a first set of openings and a second set of openings offset from the first set of openings, angling the satellite dish and inserting one or more first hooks of a mount to the first set of openings, activating a spring in one or more spring loaded second hooks of the mount such that the one or more spring loaded second hooks clear a bottom of the second set of openings, inserting the one or more spring loaded second hooks into the second set of openings and releasing the spring in the one or more spring loaded second hooks of the mount to lock the satellite dish to the mount.

BRIEF DESCRIPTION OF THE DRAWINGS

The teachings of the present invention can be readily understood by considering the following detailed description in conjunction with the accompanying drawings, in which:

FIG. 21 illustrates various views of the first hook;

FIG. 22 illustrates various views of a housing associated with the second hook assembly;

FIG. 23 illustrates various views of the second hook;

FIG. 24 illustrates an isometric front view of the second hook assembly;

FIG. 25 illustrates a front view of the second hook assembly;

FIG. 26 illustrates a side view of the second hook assembly;

FIG. 27 illustrates an exploded view of the second hook assembly; and

To facilitate understanding, identical reference numerals have been used, where possible, to designate identical elements that are common to the figures.

DETAILED DESCRIPTION

The present disclosure relates to a snap attachment for reflector mounting. As noted above, satellite dishes are relatively heavy and installed in higher locations, which make installation of the satellite dishes challenging. For example, current satellite dish installation requires the use of a nut and bolt to anchor the satellite dish to a mount. Such an installation may require multiple people, thereby leading to longer install times and labor costs.

In one embodiment, the present disclosure provides a snap attachment for reflector mounting. The snap attachment allows a satellite dish to be installed without any additional hardware and allows for a single person to install the satellite dish. As a result, install times and labor costs may be reduced.

Figure 1:
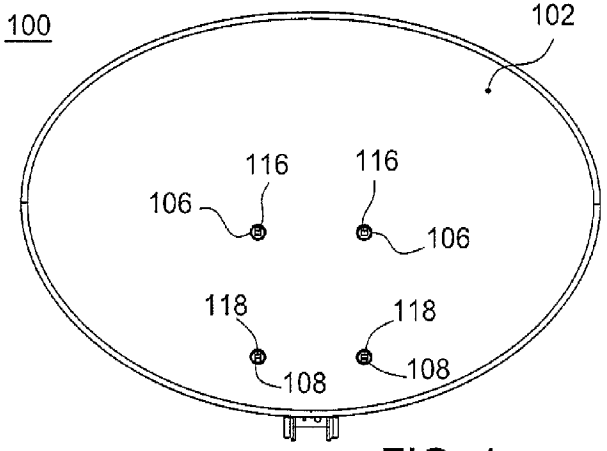
FIG. 1 illustrates a front view of a reflector attached to a mount.

FIG. 1 illustrates one embodiment of a front view of a satellite dish installation system 100. The satellite dish installation system 100 may include a reflector 102 of a satellite dish attached to a mount 104 (see FIG. 2). The reflector may include a first set of openings 106 and a second set of openings 108. In one embodiment, one or more first hooks 116 of the mount 104 may be inserted into the first set of openings 106 and one or more second hooks 118 may be inserted into the second set of openings 108 to securely mount the reflector 102 to the mount 104. In one embodiment, the one or more first hooks 116 may comprise any similar structure, such as for example, pins, tabs, grommets, and the like.

In one embodiment, the reflector 102 may be fabricated to accommodate the one or more first hooks 116 and the one or more second hooks 118. In other words, the first set of openings 106 and the second set of openings 108 may be designed to be similar in size and structure to engage the one or more first hooks 116 and the one or more second hooks 118, respectively.

Figure 2:
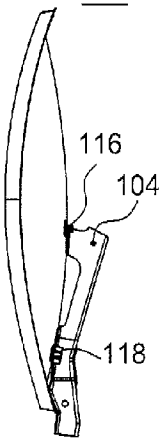
FIG. 2 illustrates a side view of the reflector attached to the mount.
Figure 3:
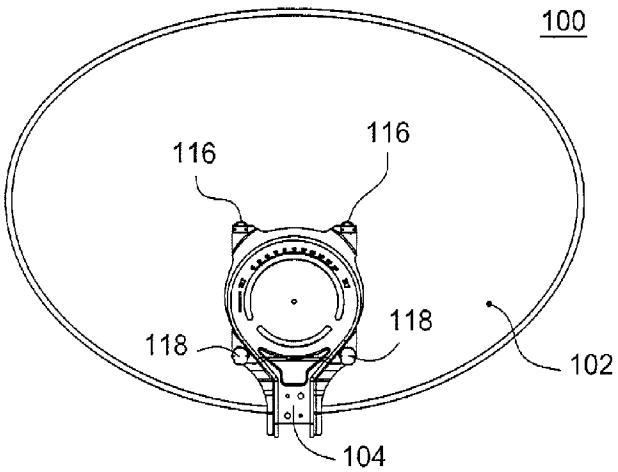
FIG. 3 illustrates a back view of the reflector attached to the mount.
Figure 4:
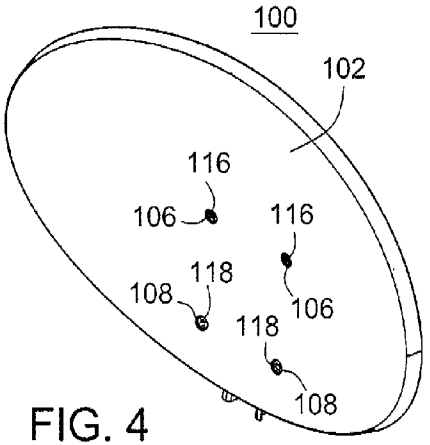
FIG. 4 illustrates an isometric front view of the reflector attached to the mount.
Figure 5:
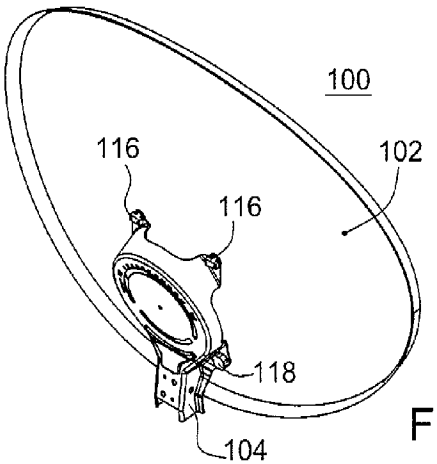
FIG. 5 illustrates an isometric back view of the reflector attached to the mount.

FIG. 2 illustrates a side view of one embodiment of the reflector 102 coupled to the mount 104. FIG. 3 illustrates a back view of one embodiment of the reflector 102 coupled to the mount 104. FIG. 4 illustrates an isometric front view of one embodiment of the reflector 102 coupled to the mount 104. FIG. 5 illustrates an isometric back view of one embodiment of the reflector 102 coupled to the mount 104.

Figure 6:
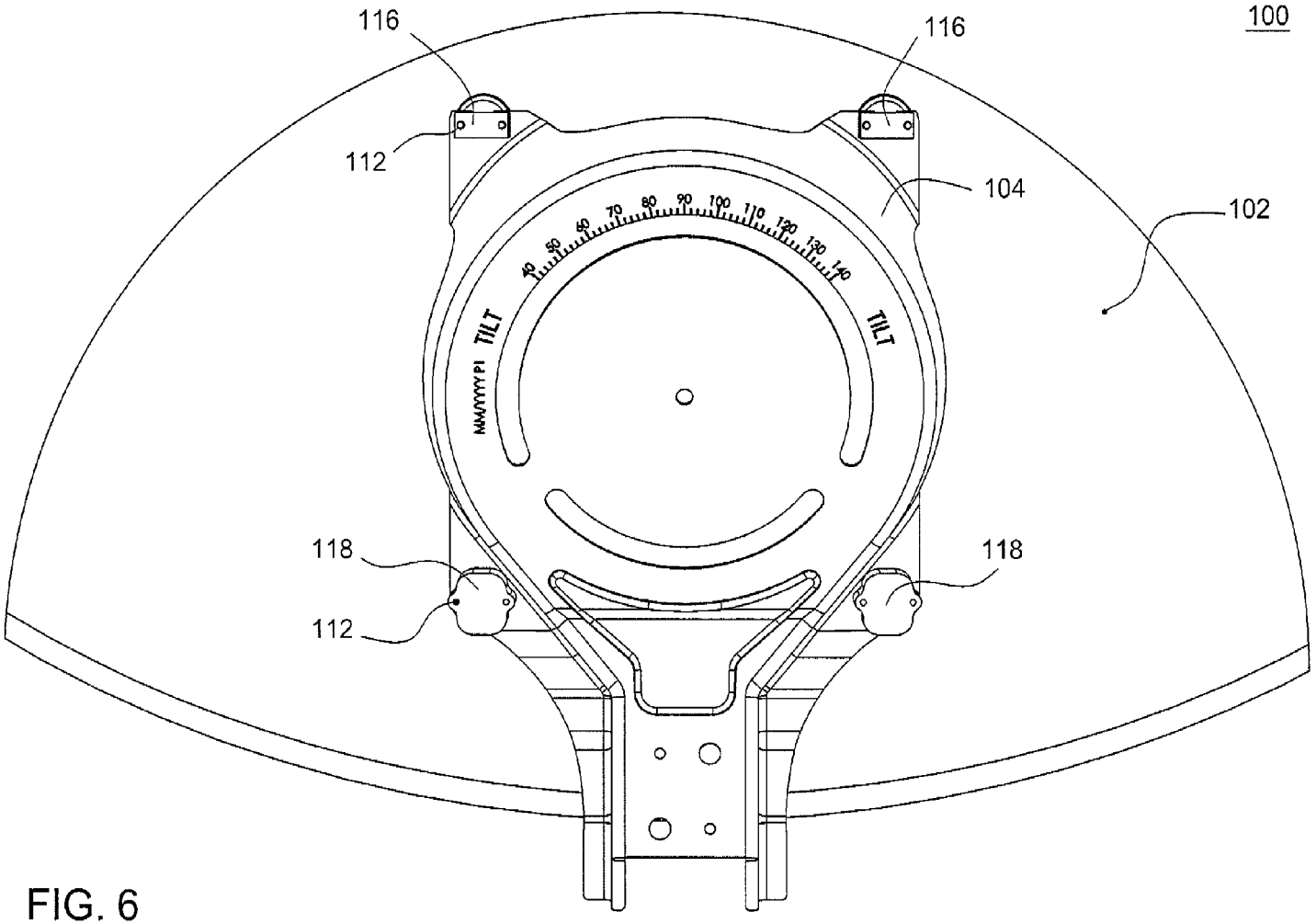
FIG. 6 illustrates a close up view of the mounting structure having a snap attach mechanism.

FIG. 6 illustrates a close up back view of the mount 104. In one embodiment, the one or more first hooks 116 and the one or more second hooks 118 may be an integrated part of the mount 104. In another embodiment, the one or more first hooks 116 and the one or more second hooks 118 may be an attachment to the mount 104. In other words, any existing mount 104 may be retro-fitted with the one or more first hooks 116 and the one or more second hooks 118.

For example, the one or more first hooks 116 and the one or more second hooks 118 may be coupled to the mount 104 using one or more fastening means through openings 112. In one embodiment, the fastening means may be a screw, nut and bolt, and the like, that are used to attach the one or more first hooks 116 and the one or more second hooks 118 to the mount 104 before the reflector 102 is mounted to the mount 104. Notably, the fastening means are not referring to any mechanism for coupling the reflector 102 to the mount 104.

In one embodiment, the one or more first hooks 116 may be coupled to one or more first tabs of the mount 104 and the one or more second hooks 118 may be coupled to one or more second tabs of the mount 104. In one embodiment, the one or more first hooks 116 and the one or more second hooks 118 may be located offset from one another. For example, the one or more first hooks 116 may be coupled to one or more first tabs located on a top portion of the mount 104 and the one or more second hooks 118 may be located on one or more second tabs located on an opposite bottom portion of the mount 104 that is offset from the one or more first hooks 116.

In one embodiment, the amount of offset may correspond to an offset between the first set of openings 106 and the second set of openings 108. In other words, the locations of the one or more first hooks 116 and the one or more second hooks 118 correspond to the locations of the first set of openings 106 and the second set of openings 118, respectively.

It should be noted that the terms "offset" and "opposite" are terms used for relative location and not absolute location or proximity. For example, the one or more first hooks 116 may be located anywhere on the reflector 102, but the one or more second hooks 118 may be offset from, located opposite to or across from the one or more first hooks 116.

Moreover, the terms "offset" and "opposite" are not intended to specify proximity or any particular distance. For example, the one or more second hooks 118 may be located any distance away from the one or more first hooks 116 as long as they are "offset" one another or "opposite" from one another.

It should be noted that although FIG. 6 illustrates two first hooks 116 and two second hooks 118, any number of first hooks 116 and second hooks 118 may be deployed. In addition, although FIG. 6 illustrates two first hooks 116 on the top and the two second hooks 118 on the bottom, the first hooks 116 and the second hooks 118 may be arranged in any orientation as long as they are opposite one another.

Figure 7:
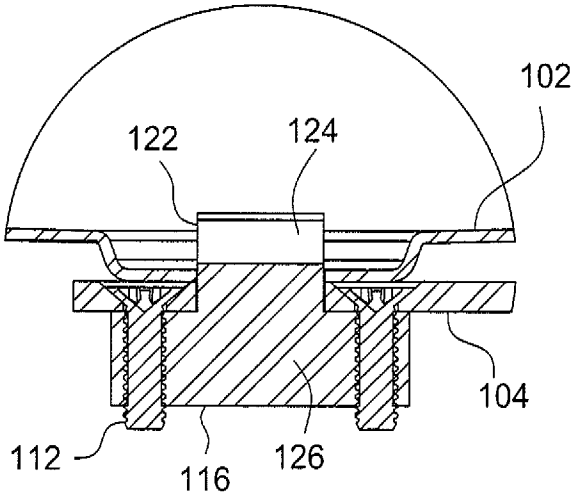
FIG. 7 illustrates a first cross-sectional detailed view of a first hook.

FIG. 7 illustrates a cross-sectional top view of the one or more first hooks 116. In one embodiment, the one or more first hooks 116 may be fixed or immobile. In other words, the one or more first hooks are integrated to the mount 104 in a fixed position and do not move during attachment to the reflector 102.

Figure 8:
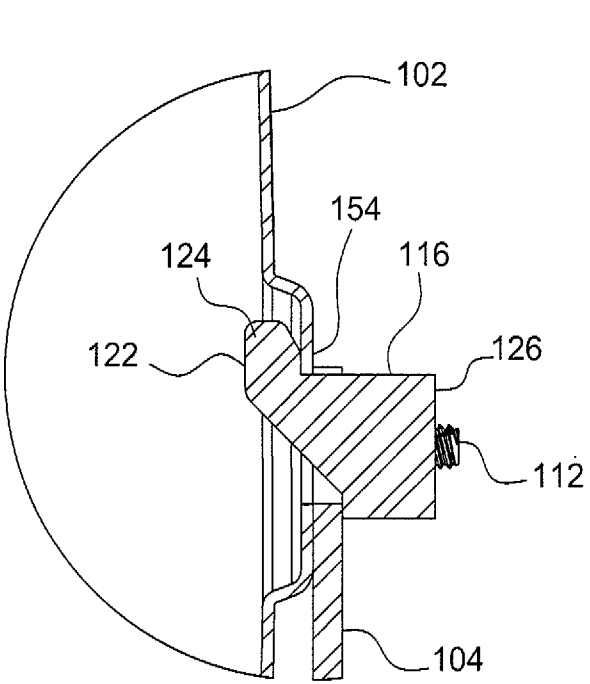
FIG. 8 illustrates a second cross-sectional detailed view of the first hook.

In one embodiment, the one or more first hooks 116 may comprise a base 116 and an angled member 122. In one embodiment, the angled member may have a lip 124 that extends above a top side of the base 126 as illustrated in FIG. 8. FIG. 8 illustrates a cross-sectional side view of the one or more first hooks 116. The lip 124 extends above the top side of the base 126 such that the lip 124 may be inserted and fixed behind an edge 154 of the opening 106 of the reflector. The lip 124 may be any shape that may "catch" the edge 154 of the opening 106, such as for example, a triangle, square, sphere, etc.

Figure 10:
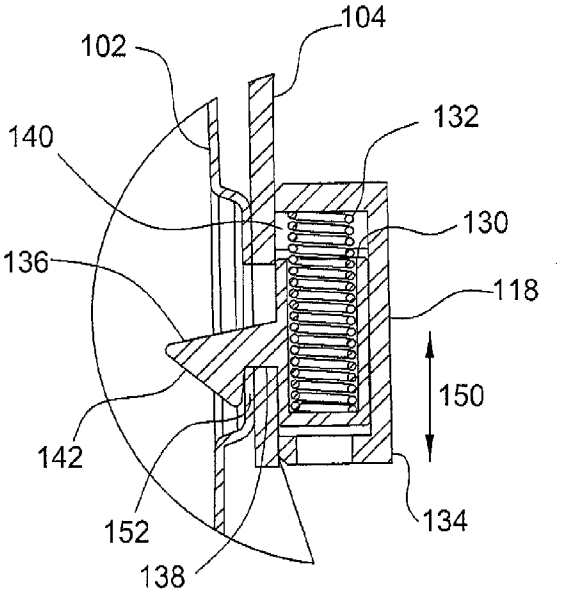
FIG. 10 illustrates a second cross-sectional detailed view of the second hook latched position.
Figure 9:
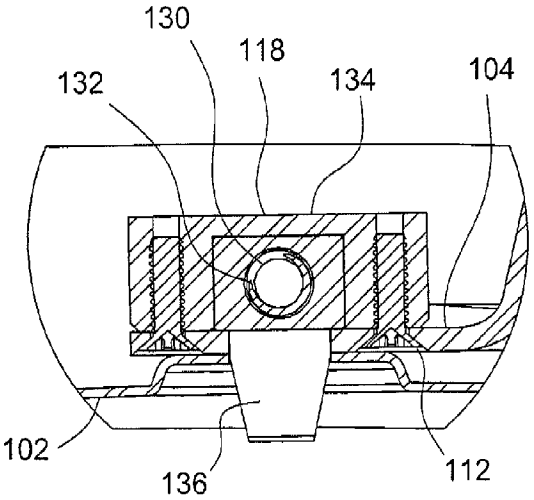
FIG. 9 illustrates a first cross-sectional detailed view of a second hook latched position.

FIG. 9 illustrates a top cross-sectional view and FIG. 10 illustrates a side cross-sectional view of one embodiment of the one or more second hooks 118 in a "latched" position. In one embodiment, the one or more second hooks may be spring loaded hooks. For example, the one or more second hooks 118 may include a housing 134. A notched member 136 may be enclosed by the housing 134. The notched member 136 may include an opening 130 for deploying a spring 132. The notched member 136 may be enclosed by the housing 134 such that a gap 140 is formed to provide clearance for a base of the notched member 136 (see FIG. 10). As a result, when the spring 132 is activated, the gap 140 provides clearance to allow the base of the notched member 136 to freely move vertically up and down, as illustrated by the direction in arrow 150, thereby, lowering and raising the notched member 136.

Although FIGS. 9 and 10 illustrate the one or more second hooks 118 being actuated by a spring 132, it should be noted that any other actuating mechanism may be used. For example, other actuating mechanisms may include hydraulics, pneumatics, or other similar mechanical means.

Figure 11:
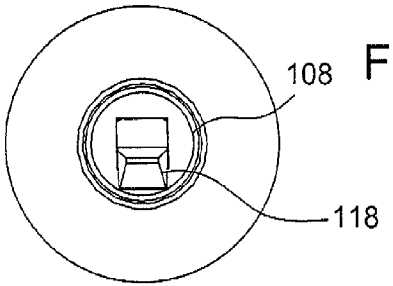
FIG. 11 illustrates a front view of a second hook in a latched position.

FIG. 10 illustrates the one or more second hooks 118 in the "latched" position. For example, the notched member 136 may have an angled lip portion 142 that forms a gap portion 138. In one embodiment, the one or more second hooks 118 may "latch" to the reflector 102 by resting the gap portion 138 onto a edge 152 of the opening 108 in the reflector 102. The angled lip portion 142 "latches" the one or more second hooks 118 to the reflector 102 such that the reflector 102 cannot be removed without activating the spring 132. FIG. 11 illustrates a close up view of one embodiment of the one or more hooks 118 in the "latched" position on the opening 108 of the reflector 102.

Figure 12:
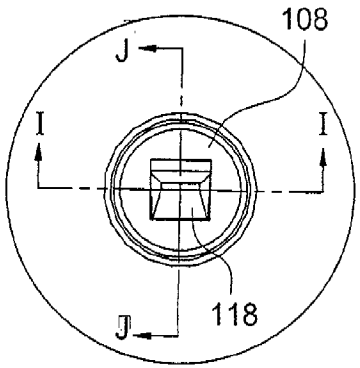
FIG. 12 illustrates a front view of a second hook in an unlatched position.
Figure 13:
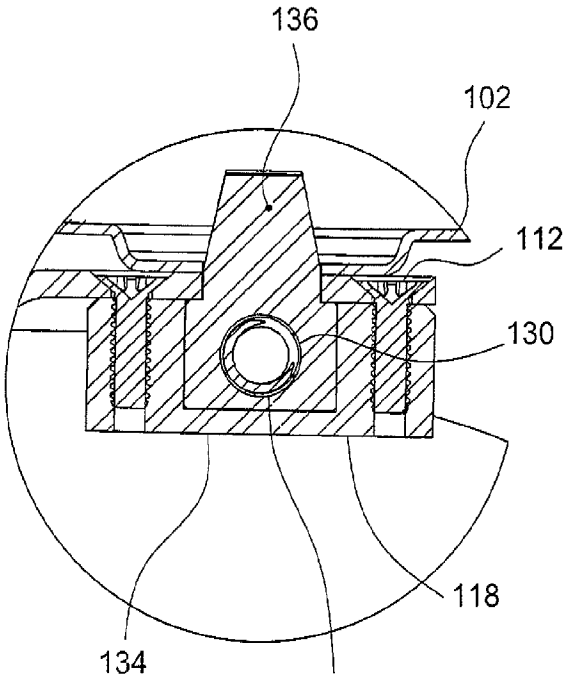
FIG. 13 illustrates a first cross-sectional detailed view of a second hook unlatched position.
Figure 14:
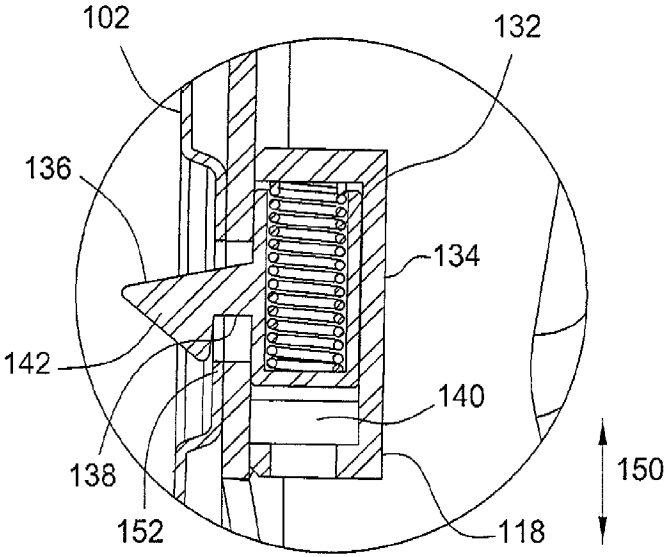
FIG. 14 illustrates a second cross-sectional detailed view of the second hook unlatched position.

FIG. 12 illustrates a close up view of one embodiment of the one or more hooks 118 in the pre-latch position in the opening 108 of the reflector 102. FIG. 13 illustrates a cross-sectional view I-I of FIG. 12 and FIG. 14 illustrates a cross-sectional view J-J of FIG. 12. FIG. 14 illustrates how the spring 132 is activated or actuated such that the gap 140 has now moved to a lower portion of the one or more hooks 118. As a result, the notched member 136 is raised such that the angled lip portion 142 clears above the edge 152 of the opening 108 and such that the gap portion 138 does not rest on the edge 152 of the opening 108. As a result, the reflector 102 may be either pushed in or pulled out at this point.

It should be noted that even in the pre-latch position the installer may let go of the reflector due to the one or more first hooks 116. For example, the one or more first hooks 116 may be inserted first to hold the reflector 102 as the installer pushes the reflector 102 in to allow the one or more second hooks to "latch" or pulls the reflector 102 out to decouple the reflector 102 from the mount 104

Figure 16:
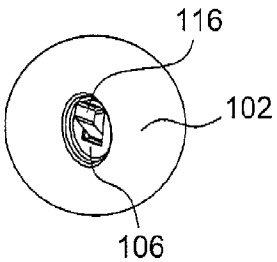
FIG. 16 illustrates a view of the first hook in the latched position.
Figure 17:
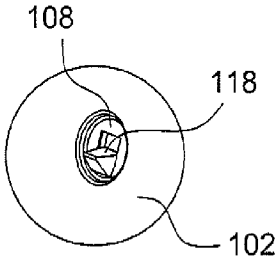
FIG. 17 illustrate a view of the second hook in the latched position.
Figure 15:
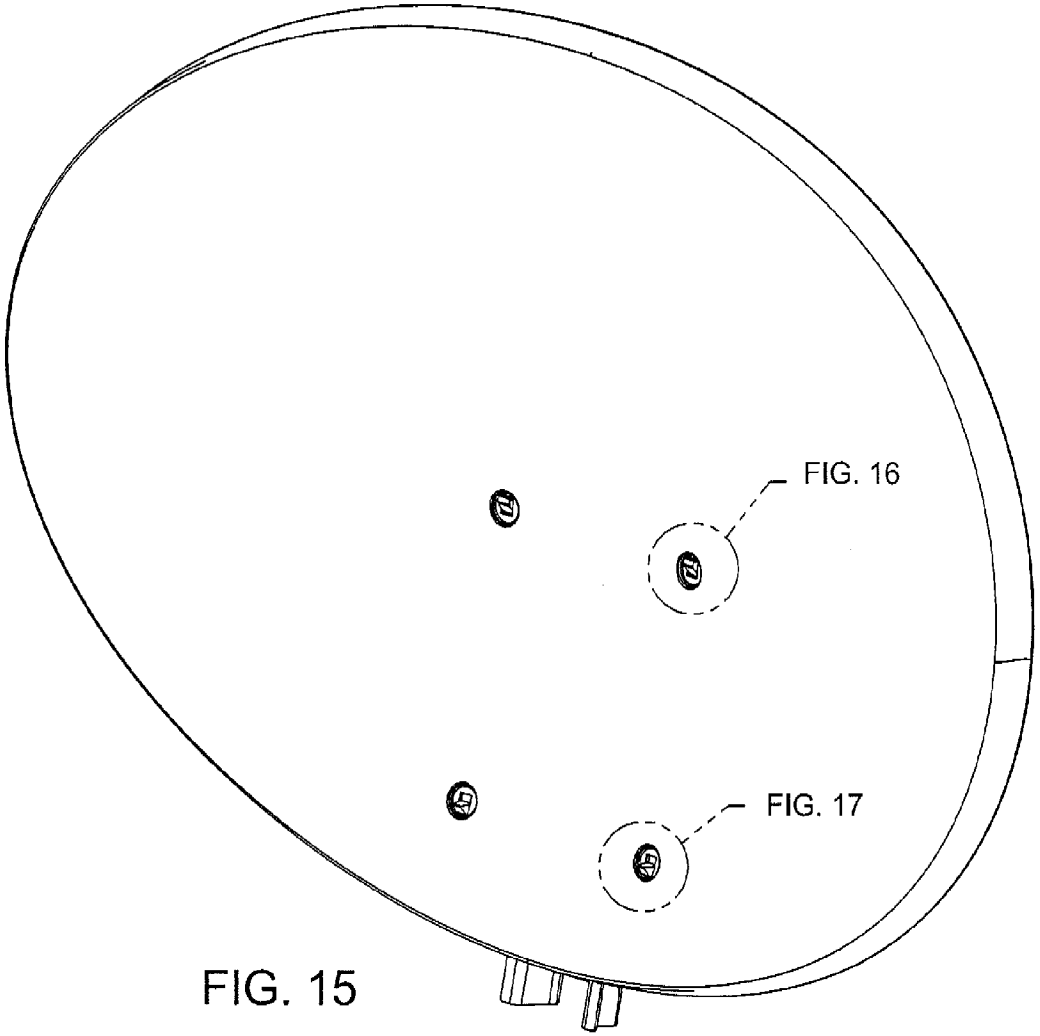
FIG. 15 illustrates an isometric front view of the reflector attached to the mount.

FIG. 15 illustrates another view of the reflector 102 mounted to the mount 104. FIG. 16 illustrates the one of the one or more first hooks 116 latched to the opening 106 and FIG. 17 illustrates one of the one or more second hooks 118 latched to the opening 108.

Figure 19:
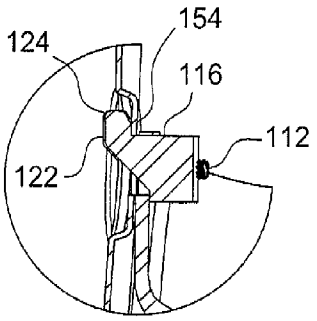
FIG. 19 illustrates a close up side cross-sectional view of the first hook.
Figure 18:
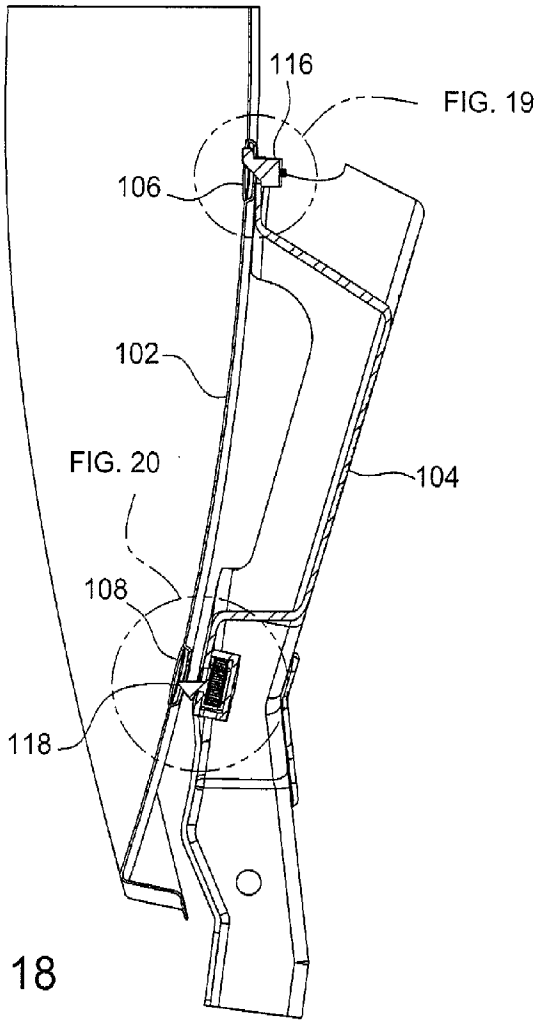
FIG. 18 illustrates a side cross-sectional view of the mount.

FIG. 18 illustrates a side cross-sectional view of the mount 104 illustrating the one or more second hooks 118 in the pre-latched position. FIG. 19 illustrates a close up view of how the one or more first hooks 116 may be inserted first into the opening 106. For example, the one or more first hooks 116 are securely latched into the opening 106 such that the lip 124 is fixed behind the edge 154 of the opening 106. The angled member 122 may be shaped such that the lip 124 may be inserted first horizontally and the reflector 102 may be angled upwards along the incline of the angled member 122 until the lip 124 is pointing vertically upwards and fixed behind the edge 154 of the opening 106.

At this point, the installer may let go of the reflector as the one or more first hooks 116 are coupled to the reflector 102 and may hold the reflector 102 in place. The installer may then finish the installation by moving the one or more second hooks 118 to the latched position.

Figure 20:
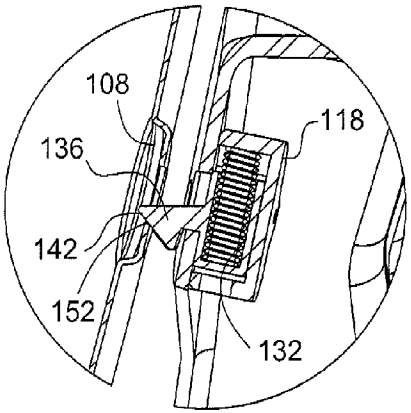
FIG. 20 illustrates a close up side cross-sectional view of the second hook.

FIG. 20 illustrates how the angled lip portion 142 is formed with an incline. As the edge 152 is pressed against the angled lip portion 142, the incline of the angled lip portion 142 continues to activate or coil the spring 132 as the angled lip portion 142 slides along the edge 152, thereby, moving the notched member 136 vertically upwards. Once the angled lip portion 142 clears the edge 152, the spring 132 is deactivated or uncoiled and the gap portion 138 may rest on the edge 152 with the angled lip portion 142 fixed behind the edge 152.

Notably, the installer is not required to manually activate the spring 132 or physically keep the spring 132 activated such that the one or more second hooks 118 may be latched. Rather, the spring 132 may be automatically activated by simply having the installer push the reflector 102 closer to the mount 104 such that the angled lip portion 142 slides against the edge 152. Once the reflector 102 is completed pushed in the one or more second hooks 118 may "click" into the latched position.

FIG. 21 illustrates various detailed views of one embodiment of the one or more first hooks 116. FIG. 21 illustrates example bottom, top, side and isometric views. FIG. 21 illustrates the openings 112 for coupling the one or more first hooks 116 to the mount 104 in an attachment embodiment.

FIG. 22 illustrates various detailed views of the housing 134. FIG. 22 illustrates example, bottom, top, side and isometric views. FIG. 22 illustrates the openings 112 for coupling the one or more second hooks 118 to the mount 104 in an attachment embodiment. In one embodiment, the housing 134 may include an opening 2202.

FIG. 23 illustrates various detailed views of the notched member 136. FIG. 23 illustrates example, bottom, top, side and isometric views. In one embodiment, the notched member 136 is coupled to a base 2302. The base 2302 may include the opening 130, as discussed above, for deploying the spring 132. In one embodiment, the opening 130 may run vertically through the base 2302. In one embodiment, the notched member 136 may include an angled lip portion 142 forming a gap portion 138.

FIG. 24 illustrates an isometric view of the one or more hooks 118 fully assembled. FIG. 25 illustrates a front view of the one or more hooks 118 fully assembled. FIG. 26 illustrates a side view of the one or more hooks 118 fully assembled. FIG. 27 illustrates an exploded view of one or more hooks 118.

Figure 28:
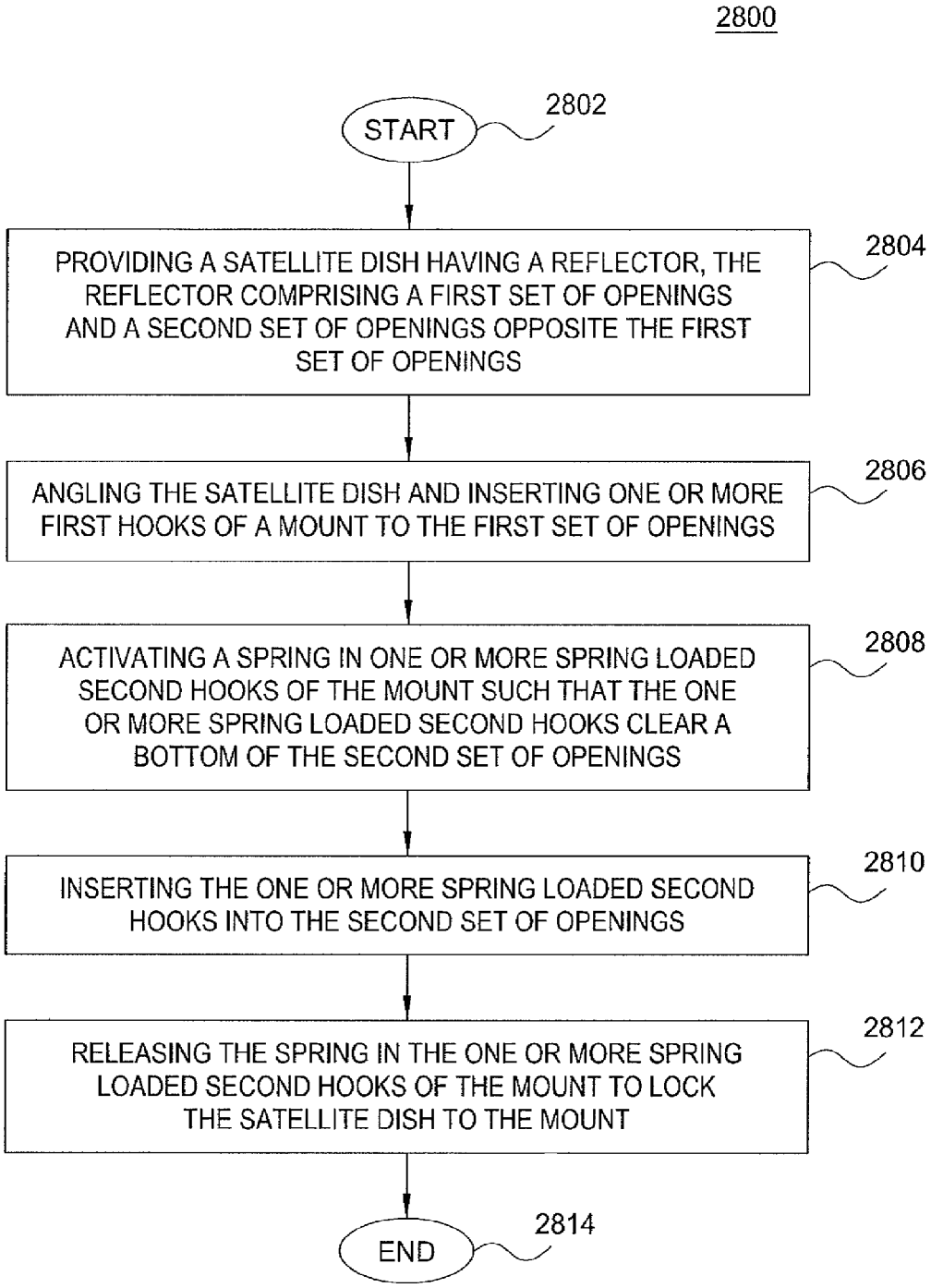
FIG. 28 illustrates a flow chart of one embodiment of a method for mounting a satellite dish.

FIG. 28 illustrates a flow chart of one embodiment of a method 2800 for mounting a satellite dish. The method begins at step 2802. At step 2804, the method 2800 provides a satellite dish having a reflector, the reflector comprising a first set of openings and a second set of openings opposite the first set of openings. For example, the reflector may have one or more first openings located on a top portion of the reflector and the one or more second openings located opposite the one or more first openings on a bottom portion of the reflector.

At step 2806, the method 2800 angles the satellite dish and inserts one or more first hooks of a mount to the first set of openings. For example, if the mount has two first hooks, each hook may be aligned with a corresponding first opening of the reflector. The satellite dish may be angled such that the each of the two first hooks are inserted into the corresponding first openings. Subsequently, the satellite dish may be lowered to such that the two first hooks are in a latched position in the corresponding first openings. At this point, the satellite dish may be secured to the mount and the installer may let go of the satellite dish safely.

At step 2808, the method 2800 activates the spring in one or more spring loaded second hooks of the mount such that the one or more spring loaded second hooks clear a bottom of the second set of openings. In one embodiment, the spring may be automatically activated once an angled lip portion of a notched member of the spring loaded second hook contacts an edge of the second opening.

At step 2810, the method 2800 inserts the one or more spring loaded second hooks into the second set of openings. For example, the installer may continue to push the second hooks into the second set of openings such that an angled lip portion of the notched member of the spring loaded second hook clears the edge of the second opening.

At step 2812, the method 2800 releases the spring in the one or more spring loaded second hooks of the mount to lock the reflector, and thereby the entire satellite dish, to the mount. For example, the notched member of the spring loaded second hook may continually move upwards as the angled lip portion slides against the edge of the second set of openings until the notched member clears the edge of the second opening. At this moment, the spring will be automatically released and the notched member will move vertically downward until a gap portion of the notched member rests on the edge of the second set of openings. The one or more spring loaded second hooks are then considered to be in a latched position and the satellite dish may be locked into position on the mount.

Notably, the method 2800 may be performed without the use of any additional tools. For example, no screwdriver or wrench is required to secure or tighten any screws or nuts.

Rather, the installer is only required to manipulate the satellite dish to align and insert the one or more first hooks and the one or more second hooks to the respective first set of openings and the second set of openings.

In addition, the satellite dish may be just as easily removed by simply reactivating the spring in the one or more spring loaded second hooks such that the one or more spring loaded second hooks clear an edge of the bottom of the second set of openings. Then the one or more spring loaded second hooks may be removed from the second set of openings and the satellite dish may be angled to remove the one or more first hooks from the first set of openings to disconnect the satellite dish from the mount. The method 2800 ends at step 2814.

Although various embodiments which incorporate the teachings of the present invention have been shown and described in detail herein, those skilled in the art can readily devise many other varied embodiments that still incorporate these teachings.

What is claimed is:

1. A mount for mounting a reflector of a satellite dish, comprising:

one or more first hooks, wherein the one or more first hooks are fixed, wherein the one or more first hooks are for fastening to one or more first corresponding openings on the reflector; and one or more second hooks located offset from the one or more first hooks, wherein the one or more second hooks are spring loaded to move vertically up and down, wherein the one or more second hooks are for fastening to one or more second corresponding openings on the reflector after the one or more first hooks are fastened to the one or more first corresponding openings on the reflector.

2. The mount of claim 1, further comprising:

one or more first tabs; and one or more second tabs.

3. The mount of claim 2, wherein the one or more first hooks are coupled to the one or more first tabs and the one or more second hooks are coupled to the one or more second tabs.

4. The mount of claim 3, wherein the one or more first tabs are located on a top portion of the mount and the one or more second tabs are located on a bottom portion of the mount.

5. The mount of claim 1, wherein each one of the one or more first hooks comprises:

a base; and an angled member coupled to the base, wherein the angled member extends above a top side of the base.

6. The mount of claim 1, wherein each one of the one or more second hooks comprises:

a base comprising an opening running vertically through the base;

a notched member coupled to the base forming a gap between the notched member and the base;

a spring located in the opening; and a housing, enclosing the base with the spring such that a gap forms providing a clearance for the base to move in a vertical direction when the spring is activated.

7. A satellite dish system, comprising:

a satellite dish comprising a reflector, the reflector comprising a first set of openings and a second set of openings offset from the first set of openings; and a mount, the mount comprising:

one or more first hooks coupled to the first set of openings, wherein the one or more first hooks are fixed, wherein the one or more first hooks are for fastening to the first set of openings of the reflector; and one or more second hooks located offset from the one or more first hooks and coupled to the second set of openings after the one or more first hooks are fastened to the first set of openings of the reflector, wherein the one or more second hooks are spring loaded to move vertically up and down.

8. The satellite dish system of claim 7, wherein the mount further comprises:

one or more first tabs; and one or more second tabs.

9. The satellite dish system of claim 8, wherein the one or more first hooks are coupled to the one or more first tabs and the one or more second hooks are coupled to the one or more second tabs.

10. The satellite dish system of claim 9, wherein the one or more first tabs are located on a top portion of the mount and the one or more second tabs are located on a bottom portion of the mount.

11. The satellite dish system of claim 7, wherein each one of the one or more first hooks comprises:

a base; and an angled member coupled to the base, wherein the angled member extends above a top side of the base.

12. The satellite dish system of claim 7, wherein each one of the one or more second hooks comprises:

a base comprising an opening running vertically through the base;

a notched member coupled to the base forming a gap between the notched member and the base;

a spring located in the opening; and a housing, enclosing the base with the spring such that a gap forms providing a clearance for the base to move in a vertical direction when the spring is activated.

13. A method for mounting a satellite dish, comprising:

providing the satellite dish having a reflector, the reflector comprising a first set of openings and a second set of openings offset from the first set of openings;

angling the satellite dish and inserting one or more first hooks of a mount to the first set of openings, wherein the one or more first hooks are fixed;

activating a spring in one or more spring loaded second hooks of the mount such that the one or more spring loaded second hooks clear a bottom of the second set of openings, wherein the spring moves vertically up and down;

inserting the one or more spring loaded second hooks into the second set of openings after the one or more first hooks of the mount are inserted into the first set of openings; and releasing the spring in the one or more spring loaded second hooks of the mount to lock the satellite dish to the mount.

14. The method of claim 13, wherein the method is performed without any tools.

15. The method of claim 13, further comprising:

activating the spring in the one or more spring loaded second hooks of the mount such that the one or more spring loaded second hooks clear the bottom of the second set of openings;

removing the one or more spring loaded second hooks from the second set of openings; and angling the satellite dish and removing the one or more first hooks from the first set of openings to disconnect the satellite dish from the mount.

16. The method of claim 13, wherein each one of the one or more first hooks comprises:

a base; and an angled member coupled to the base, wherein the angled member extends above a top side of the base.

17. The method of claim 13, wherein each one of the one or more spring loaded second hooks comprises:

a base comprising an opening running vertically through the base;

a notched member coupled to the base forming a gap between the notched member and the base;

a spring located in the opening; and a housing, enclosing the base with the spring such that a small gap forms providing a clearance for the base to move in a vertical direction when the spring is activated.

* * * * *